US005729936A

United States Patent [19]

Maxwell

[11] Patent Number: 5,729,936

[45] Date of Patent: Mar. 24, 1998

[54] PREFAB FIBER BUILDING CONSTRUCTION

[76] Inventor: James F. Maxwell, 722 E. 2730 N, Provo, Utah 84604

[21] Appl. No.: 538,728

[22] Filed: Oct. 3, 1995

[51] Int. Cl.[6] ..... E04C 2/18

[52] U.S. Cl. ..... 52/220.2; 52/220.3; 52/220.7; 52/600; 52/606; 52/612; 52/630; 52/DIG. 9

[58] Field of Search ..... 52/220.1, 220.2, 52/220.3, 220.7, 340, DIG. 9, 794.1, 600, 606, 612, 630, 309.16

[56] References Cited

U.S. PATENT DOCUMENTS

| | | | |
|---|---|---|---|
| 142,475 | 9/1873 | Hyatt | 52/600 |
| 536,993 | 4/1895 | Allen | 52/315 |
| 756,749 | 4/1904 | Watts, Jr. | 52/220.7 |
| 1,541,165 | 6/1925 | Miache | 428/446 |
| 1,692,783 | 11/1928 | McManus | 52/612 X |
| 1,809,504 | 6/1931 | Carvel | 52/745.11 |
| 1,875,888 | 9/1932 | Richardson | 52/794.1 |
| 2,261,480 | 11/1941 | Morrell | 52/612 X |
| 3,697,633 | 10/1972 | Edgar | 52/220.2 X |
| 3,821,818 | 7/1974 | Alosi | 52/220.2 X |
| 3,831,335 | 8/1974 | Ary | 52/220.2 X |
| 3,857,752 | 12/1974 | McCoy | 52/DIG. 9 |
| 3,868,300 | 2/1975 | Wheeler | 162/124 |
| 3,905,170 | 9/1975 | Huettemann | 52/314 X |
| 4,147,004 | 4/1979 | Day et al. | 52/794.1 X |
| 4,154,030 | 5/1979 | Huguet | 52/DIG. 9 |
| 4,187,275 | 2/1980 | Bracalielly et al. | 264/511 |
| 4,236,365 | 12/1980 | Wheeler | 52/309.16 X |
| 4,554,124 | 11/1985 | Sudrabin | 52/612 X |
| 4,649,682 | 3/1987 | Barrett, Jr. | 52/220.2 X |
| 4,856,244 | 8/1989 | Clapp | 52/220.1 X |
| 4,981,003 | 1/1991 | McCarthy | 52/309.16 X |
| 5,102,596 | 4/1992 | Lempfer et al. | 264/115 |
| 5,177,924 | 1/1993 | Kakuk | 52/DIG. 9 |
| 5,302,331 | 4/1994 | Jenkins | 264/115 |
| 5,519,971 | 5/1996 | Ramirez | 52/220.2 |
| 5,537,789 | 7/1996 | Minke et al. | 52/313 |
| 5,600,930 | 2/1997 | Drucker | 52/794.1 X |

FOREIGN PATENT DOCUMENTS

| | | | |
|---|---|---|---|
| 904600 | 7/1972 | Canada | 52/DIG. 9 |
| 2307930 | 11/1976 | France | 52/DIG. 9 |
| 2458643 | 2/1981 | France | 52/220.3 |
| 4000956 | 2/1991 | Germany | 52/600 |

*Primary Examiner*—Carl D. Friedman
*Assistant Examiner*—Laura A. Callo
*Attorney, Agent, or Firm*—Delbert R. Phillips

[57] ABSTRACT

Prefabricated panels are formed by compressing a fiber slurry which may be composed of waste fiber products such as waste paper, cardboard, straw, leaves and grass clippings. The slurry, which may contain waterproofing, fire retardants, anti fungal agents and insecticides, is poured into a press form which contains the framework of a roof panel, wall panel, ceiling panel or floor panel as well as electrical wiring, heating ducts, plumbing or any other desired component. The fiber slurry is compressed to at least ¼ of its original volume forming a solid dense inner core. This inner core can be covered with wall board, wall board paper, stucco, plaster, cement or stone. A method for locking the panels together is also disclosed.

32 Claims, 11 Drawing Sheets

PREFAB FIBER BUILDING CONSTRUCTION

BACKGROUND OF THE INVENTION

There is a need for utilization of fibrous products such as waste paper, leaves, grass clippings, cardboard, and straw or any other compressible, organic fibrous substance. Up to this point in time, the majority of these products have been burned or dumped in land fills. Very little of these waste products have been recycled into other useful products. A method of utilization of these waste products has been developed by using these fibrous materials in the construction of buildings.

Various methods of prefabrication of structural building panels out of various types of material are known. U.S. Pat. No. 536,993 to J. T. Allen issued April, 1895 describes a method of forming panels from chips of stone or slag embedded in a plastic material wherein interstices between the chips are partially filled with sand. U.S. Pat. No. 2,839,312 to H. Serliner issued Jun. 24, 1958 claims a structural panel consisting of a thin layer of high strength concrete on both sides of a metal framework. The space between the two high strength layers of concrete is filled with a light weight low strength concrete containing a layer of aggregates.

U.S. Pat. No. 4,784,821 to Leopold issued Nov. 15, 1988 describes a method of forming concrete blocks with stone facings. U.S. Pat. No. 5,186,883 to Beall, III issued Feb. 16, 1993 is drawn to a method of forming concrete blocks with a core of insulation.

U.S. Pat. No. 5,078,937 to Eela issued Jan. 7, 1992 is drawn to a method and system of using fibrous material mixed with concrete and binder to form a slab like product.

U.S. Pat. No. 4,605,529 to Zimmerman issued Aug. 12, 1986 delineates a method of constructing a concrete wall structure containing precast concrete studs to form a framework. An initial layer of concrete is poured in a form the size of the final wall panel. The precast framework is placed on the initial layer of concrete. Standard insulation is fastened over the preformed framework. A layer of steel mesh is placed on top of the insulation. Another layer of concrete is poured over the steel mesh. The wall structure is then allowed to dry.

U.S. Pat. No. 4,548,007 to Newman issued Oct. 22, 1985 depicts forming a prefabricated wall section from concrete blocks. U.S. Pat. No. 5,102,596 to Lempfer et al. issued Apr. 7, 1992 describes a molding composition of fiber and gypsum or hydraulic cement.

U.S. Pat. No. 5,302,331 to Jenkins issued Apr. 12, 1994 is drawn to recycling household waste by pulverizing it to a powder. Adding water and a binder and pouring the slurry into a mold and allowing the slurry in the mold to dry. The mold can be in a form of block or a panel.

U.S. Pat. No. 1,202,341 to A. H. Weisser issued Oct. 24, 1916 characterizes the formation of a concrete block utilizing flexible diaphragms that provide a means of formation of hollow chambers in the block when the cement is poured in the mold.

U.S. Pat. No. 1,541,165 to Minache issued Aug. 17, 1923 describes a thin composite that is used as non weight bearing wall board. The composite is composed of 3 layers. The 2 outer layers are formed from magnesium chloride, water, glass, calcined magnesium carbonate and coloring matter. The inner layer is composed of dry pulverized organic waste, calcined magnesium carbonate, magnesium chloride, and water. The 3 layers are compressed by a pressure of 50 kilograms per centimeter.

U.S. Pat. No. 4,185,437 to Robinson issued Jan. 29, 1980 describes a wall panel formed from a steel framework covered with reinforced concrete. U.S. Pat. No. 1,809,504 to Carvel issued Jun. 9, 1931 is drawn to a method of forming a concrete wall section with masonry or brick facings. A form is bulk, stones or brick are placed in the form. Cement is poured over the layer of brick or stone forming a brick or stone facing.

None of the prior art discloses or suggests a prefabricated panel composed of compressed fiber with framing members embedded in the compressed waste fibers.

SUMMARY OF THE INVENTION

The invention herein described is a new method to process waste fiber products in bulk to form sections of walls, floors, roofs and ceilings for domestic and commercial buildings. Fibrous waste products are processed by shredding and tumbling with water in a mixer or processing through a hammer mill. A large mixer is loaded with a slurry composed of processed fibrous waste material and enough water to produce a flowable mixture. The slurry may additionally contain water proofing agents, anti fungal agents, glue, preservatives, and/or fire retardants. The fibrous slurry has a very high water content. This slurry mix is poured into a press form which has an infrastructure for walls, roofs, or ceilings including, floors joist, wall studs, door and window framing, plates, and/or spandrels as components of the infrastructure. These components are fastened together in a typical fashion to provide a framework for the infrastructure. This framework is placed in the bottom of the form. Electrical wiring, including outlet and/or junction boxes, communication component including TV antenna wiring, fiber optic cable, telephone and intercom wiring; plumbing components including pipes; heating ducts; and components of a vacuum systems may optionally be a part of, or attached to, the framework. A system for locking the panels to each other and/or to the foundation of the building is also placed in the form as part of the framework. Cut-outs for windows and doors which have dimensions of the final openings for the doors and windows are placed in the framework before the addition of the fiber slurry. When the compression is complete, the compressed fiber is knocked out of these cutouts and re-processed as waste fiber for subsequent batches of building panels.

Optionally rods are placed through positioning holes in the form and extend through the form to positioning holes in the opposite side of the press form. The rod positioning holes are placed in opposite sides of the press form to position the rods slightly above the infrastructure of the panel. After the fiber slurry is compressed, the rods extend through the compressed fiber core above the infrastructure. The positioning holes may have gaskets that prevent escape of slurry.

Top and bottom pressing surfaces of the press form are rigidly constructed so they maintain a flat surface when high pressure is applied and are porous enough to allow only water to escape during compression. The four sides of the press form are detachable and are removed from the compressed fiber core after compression providing a method for leaving the rods in place in the compressed fiber core. The sides of the press form are rigidly constructed so that they do not deform during compression. The sides of the press form additionally may be porous to allow water to escape through them during compression. A grid of hydraulic cylinders spaced over the top of the form provide high even pressure for compressing the wet slurry. Most of the water will be squeezed out during compression of the fiber slurry leaving a dense solid structural compressed fiber core with a very low water content. The fiber slurry is compressed to a point where the compressed core maintains its dimensions and remains stable during further drying. The preferred pressure is 2,000 to 10,000 pounds per square foot which can be supplied by a press with 8 large rams being in contact with the top plate of the form.

If a concrete or stucco exterior is desired, the solid compressed fiber core containing the frame work of the panel is removed from the press form and is placed in a second form which is slightly larger than the compressed fiber core. The first and second sides of the second form which contain holes to accommodate the rods that are extending from the compressed core, are then slid over the rods extending from the compressed fiber core and fastened to the third and forth sides which do not contain holes for the rods, to assemble the second form. A thin layer of flowable curable material such as stucco or concrete is placed on the bottom surface of the second form. If both the interior and exterior surfaces of the finished panel are to be the flowable material such as stucco or concrete, this flowable curable material is then placed around the edges and over the top of the compressed fiber core to completely enclose it. The rods are then removed through the sides of the form producing passageways through the finished panel. The completed panel is then removed from the form and drying is accomplished by either blowing air through the passageways or the application of vacuum after covering completed section with an air tight covering. The drying continues until the compressed fiber core is dry and the flowable material is properly cured. The drying passageways are plugged and sealed. The finished panel is then ready to be transported and erected.

If the finished panel is to have a flowable curable exterior or flowable curable interior covering, a steel mesh or chicken wire is rippled through the form. Flat bars are placed intermittently to position portions of the mesh at the surface of the compressed fiber core to form bonding points for the flowable curable materials. If flowable curable material is to be used as a covering for the exterior of the finished wall, mesh and bars are placed in the top of the form before compression and after the slurry has been added to the form. If the interior surface is to be composed of flowable material, additional mesh and bars are placed in the bottom of the form before the addition of the waste fiber slurry. As the slurry is compressed in the form, the additional bars and mesh remain at the top surface of the compressed core. After compression all of the flat bars are removed leaving depressions in the compressed core with wire mesh exposed covering the top of the depressions, which allows the flowable curable material to be bonded securely to the compressed fiber core.

If the interior surface of the finished panel which has an exterior surface of flowable curable material, is to be wall board, paper, or other covering material, the compressed fiber core is removed from the second form after the layer of flowable curable material on the bottom of the second form is sufficiently dry to adhere to the surface of the compressed core. After the compressed core is removed from the second form, the rods are extracted from the compressed core. Air is then blown through the passageways formed by the removal of the rods, thereby hastening the final drying of the compressed core. Wallboard, paper, or other finishing material is then applied to the interior surface of the compressed core. The finished panel with the exterior of flowable curable material is ready to be transported and erected.

An alternative method for covering the exterior side of the panels is as follows: rocks of uniform size are placed in a shallow, third form with a flat bottom which is slightly larger than the compressed fiber core. This third form has holes in the bottom that are plugged to contain water. The bottom of the third form is placed on a flat surface having refrigeration units attached to the underside of the flat surface. The refrigeration unit could consist of refrigeration coils affixed to the underside of the flat surface. Rock is placed evenly to cover the form with every rock touching the bottom of the form. Water is poured in the form to a depth not to exceed one-third the diameter of the rock. The refrigeration unit is run until water is frozen into ice. Stucco material is screened over the rock to a depth of at least one forth inch deeper than the rock diameter, and the fiber core is placed on the top of the rock and ice. Four side panels having the dimensions of the flat third form are placed around the compressed fiber core forming a frame around the compressed fiber core that is slightly larger than the compressed fiber core. The two sides of the third form opposite each other have holes to accommodate the rods extending from the compressed fiber core. These two sides are slipped over the rods extending from the compressed fiber core and are attached to the other two sides forming a frame which when placed on the top of the bottom of the third form to complete the third form. The compressed fiber core surrounded by the frame formed from the sides of the third form is then placed on top of the prepared rock, ice, and stucco surface. Stucco or concrete is poured around the compressed fiber core in the frame. The third form around the core is larger than the compressed fiber core accommodating an envelope of stucco to be poured around the sides and top of the core. Optionally the external surfaces of the compressed fiber core can be covered with water-proof glue before the stucco is applied. After the stucco is initially set the refrigeration unit is shut off and the plugs are removed allowing the ice to melt and the water to drain away from the stone facing of the panel. The completed panel is removed from the third form and the rods are removed leaving open passageways. Air or vacuum is used to complete drying of the panel.

The finished panels with the flowable curable envelope enclosing the compressed core, with the infrastructure embedded therein, have a durable interior and exterior surface. By using waterproof stucco or cement and adding fire retardants to the slurry before compression, the panels are waterproof and fire resistant.

In another aspect of the invention the press form without positioning holes for the rods may be used. After compression the dried fiber core can be covered with coverings other than flowable curable material such wall paper, wall board paper, sheet rock type paper, paint and paneling. This option produces thinner panels suitable for interior walls, floors and ceilings. The reduced thickness of the fiber core in these panels accelerates drying.

Optionally when the infrastructure is formed from metal, before the addition of the fiber slurry, slots are formed in the base of the panel which will match threaded bolts anchored into in the foundation of the building. When the panels are installed they are pushed on to the anchor bolts and the bolts being larger than the slots in the base crimp the edges of the holes securely grasping the threads of the bolts thereby locking the panel to the foundation. This locking system does not require a nut for fastening the panel to the bolt.

DESCRIPTION OF THE INVENTION

A prefabricated panel is designed to fit together with other prefabricated panels of the same design to form walls, floors, ceilings and roofs of buildings. The panel has a solid inner core formed by compressing the fiber slurry in a form at extreme pressures sufficient to eliminate shrinkage or swelling of the compressed fiber core during the subsequent drying process. Infrastructure members formed from materials individually selected from the group consisting of metal including aluminum and steel, wood, and high tensile plastic are placed in the form before the addition of the fiber slurry. The framing members may include cantilevers, trusses, sill plates, top plates, sills, joists, studs, rafters, spandrels, beams, and/or lintels. The inner core is removed from the form and dried. The infrastructure is embedded in the inner core. A first and second covering is applied to the inner core. The first and the second covering form the interior and exterior surface of the prefabricated panel. The prefabricated panel may optionally have electrical, plumbing and heating and other components placed in the form before the addition of the fiber slurry. Fire retardants, glue, water proofing and/or antifungal agents are optionally added to the fiber slurry before filling the form. The first and second coverings of the panels are individually selected from the group consisting of wall board; brick, paneling, wall paper, sheet rock paper; and curable flowable material that becomes solid after curing such as plastic materials, stucco, stucco with embedded stones in the stucco, mortar, cement, and cement with embedded stones in the cement. Steel mesh may be embedded in the inner core near the surface enabling the covering to bond with the compressed fiber slurry. Removable rods extending through the sides of the form are placed in the form before the addition of the fiber slurry. The rods are removed from the inner core providing air passageways to promote drying of the inner core.

The prefabricated panels are made by placing in a press form the infrastructure of the prefabricated panels, which may include electrical, plumbing and heating components. The form is then filled with a fiber slurry. The slurry is then compressed to ¼ to ½ of its original volume. The compressed fiber core is removed from the press form and dried. A covering is then placed on the top and bottom of the compressed fiber core to form the interior and exterior sides of the panel. Rods, which extend beyond edges of the compressed fiber core are optionally placed in the press form before filling with the fiber slurry. The rods are removed after the slurry is compressed. Further drying is accomplished by forcing air through the passageways formed by the removal of the rods. Optionally a vacuum source can be applied to the passageways extracting moisture from the compressed fiber core. The compressed fiber core may be placed, after removal from said press form, into a second form slightly larger than the compressed fiber core. Before the compressed fiber core is placed into the second form a layer of flowable material which may be stucco, plaster or cement, is poured in to the second form. If the flowable material is to cover the interior and exterior surface of the compressed fiber core, an envelop enclosing the remainder of the compressed fiber core is formed by pouring the flowable material around the uncovered portions of the compressed fiber core before removing the compressed fiber core from the second form. The flowable material is allowed to solidify. The compressed fiber core, with the solidified layer of flowable material adhering to it, is removed from second form and further dried. Stones of uniform size may be placed in the layer of flowable material in the bottom of the second form to produce a stone exterior on the prefabricated panel. Water may be poured over the stones to a depth not to exceed ⅓ of the diameter of the stones. The water is frozen and a layer of finishing material is spread over the ice and stone layer. The finishing material is allowed to solidify before thawing the ice and draining the water producing a pristine stone exterior. The finishing material can be plain or colored mortar, cement or stucco.

Prefabricated panels may be locked together by attaching a first channel member to the framework of a first panel along the connecting edge of the first panel. A second channel member may be attached to the framework of a second panel along the connecting edge of the second panel or the second channel member may be embedded in the concrete foundation. The first and second channel member extend the length of the connecting edges of the first and said second panels. The first and second channel member have a first side, second side and third side, and an open forth side extending the length of the channels. The first sides and the third sides are opposite each other. The second sides and the fourth open side are opposite each other. The first sides and the third sides have projections extending the length of the channel members. The building panels are placed with the open forth sides of the channel members opposing each other. A closing member is forced into the space formed by the open forth sides of the first and the second channel members. The closing member is formed to engage the projections on the opposing channel members; thereby locking the prefabricated panels together. The projections may be formed by bending the edge of the first and the third side to form lips that engage the closing member. The closing member may be formed from third and forth additional slightly smaller channel members which have edges bent to engage the lips of the larger channel members. The third and fourth channel members are placed back to back, engaging the lips formed by bending the first and third sides of the first and second channel member. The third and forth channel members are forced into the opening formed between the first and second channel members securely locking the panels together. Prefabricated building panels may be anchored to the foundation by the same locking mechanism as described above wherein a channel member is embedded in the concrete foundation with the open side up and a second channel member is affixed to the base plate of the infrastructure of a wall panel with the open side opposing the open side of the channel member embedded in the concrete foundation.

Another method of anchoring the wall panels to the foundation is by cutting slots in the metal base plate of the infrastructure slightly narrower than threaded bolts that are embedded in the foundation. The wall sections with the slots are forced down on the threaded bolts thereby crimping the edges of the slots to securely engage the threads on the bolts, thus locking the wall sections to the foundation.

DETAILED DESCRIPTION OF THE INVENTION

Figure 1:
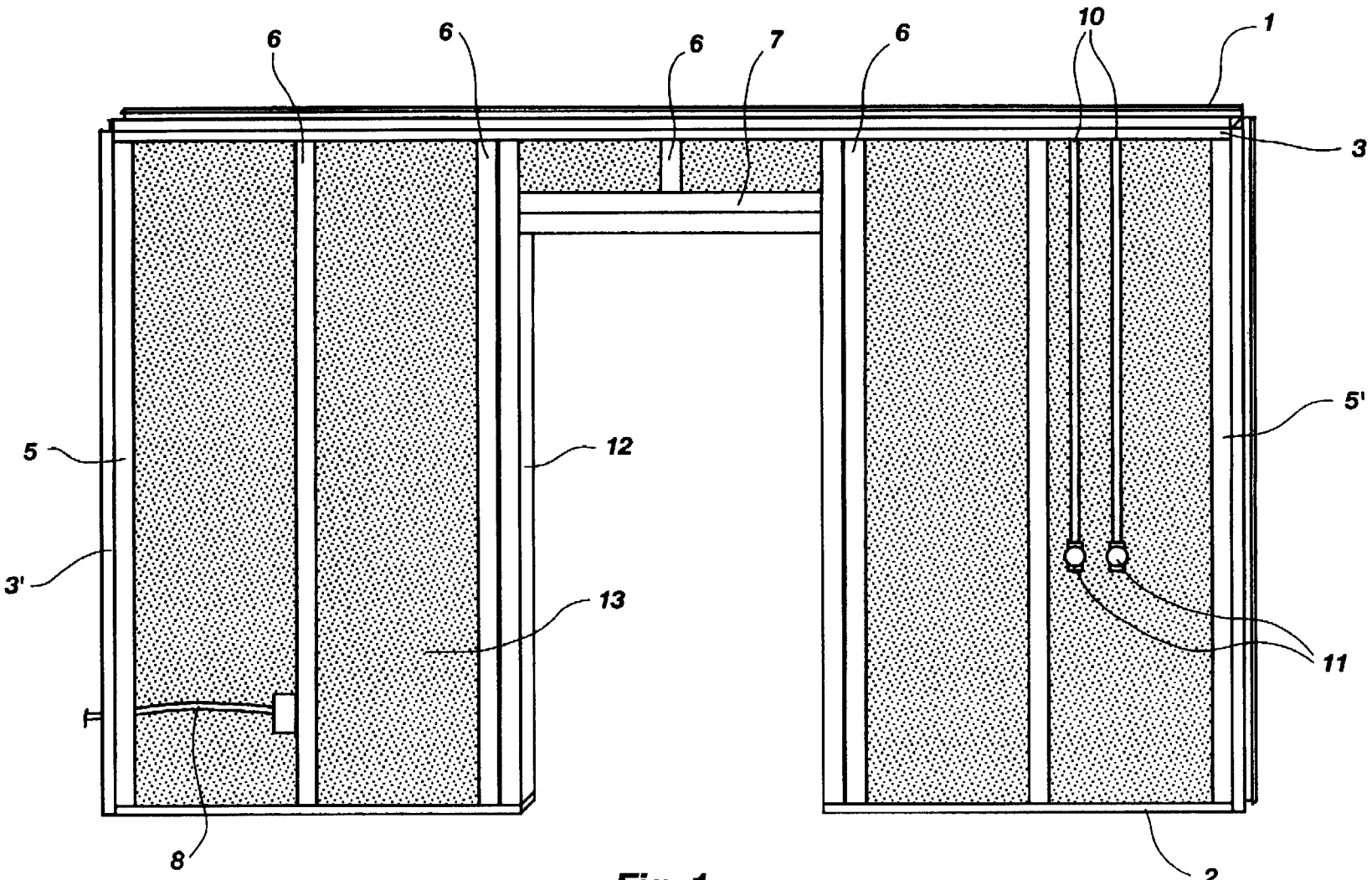
FIG. 1 Depicts a section of prefabricated building panel with an inner core of compressed fiber and without an outer covering.
Figure 2:
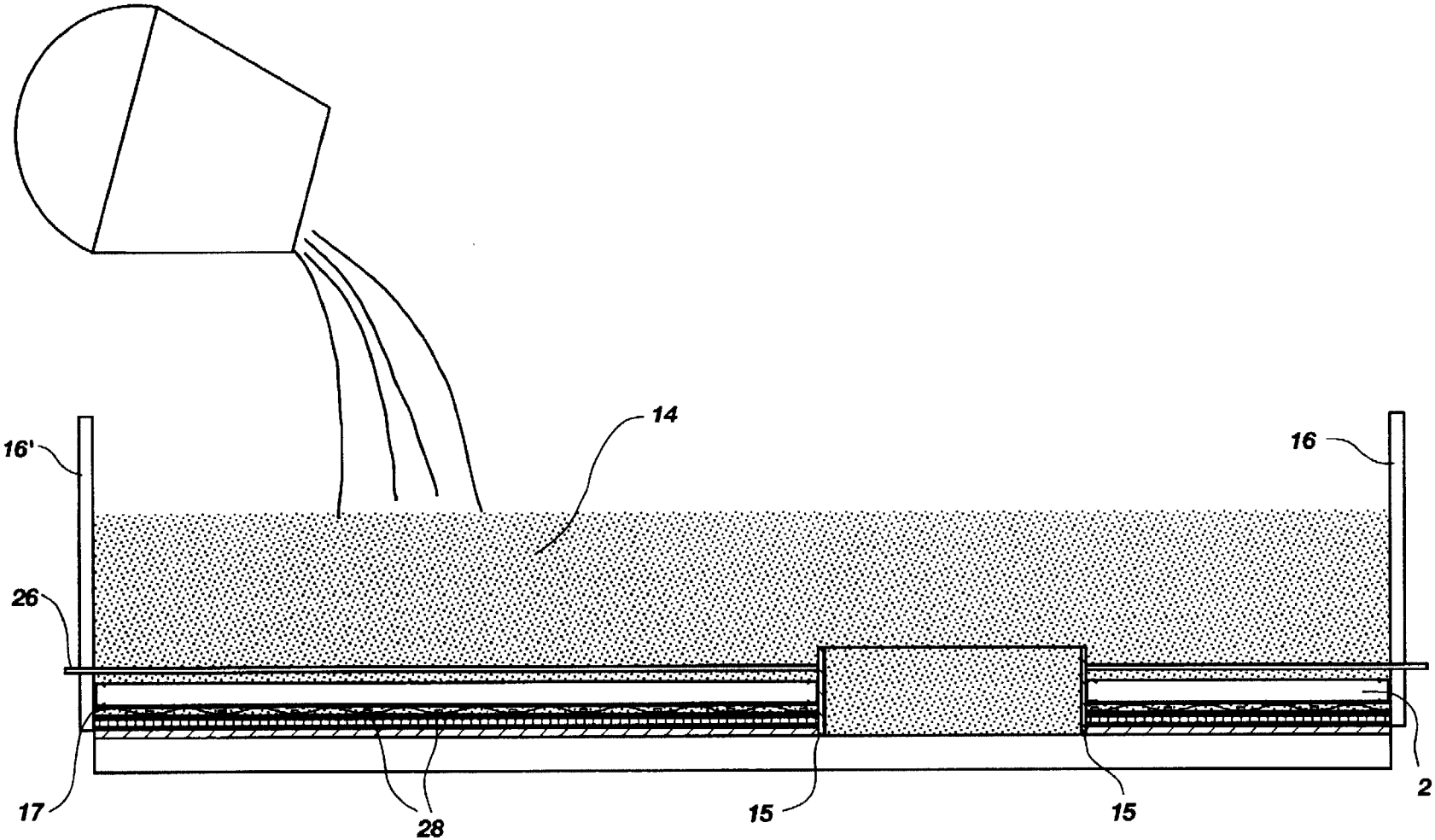
FIG. 2 Depicts the filling of the pressing form with liquid fiber slurry.
Figure 3:
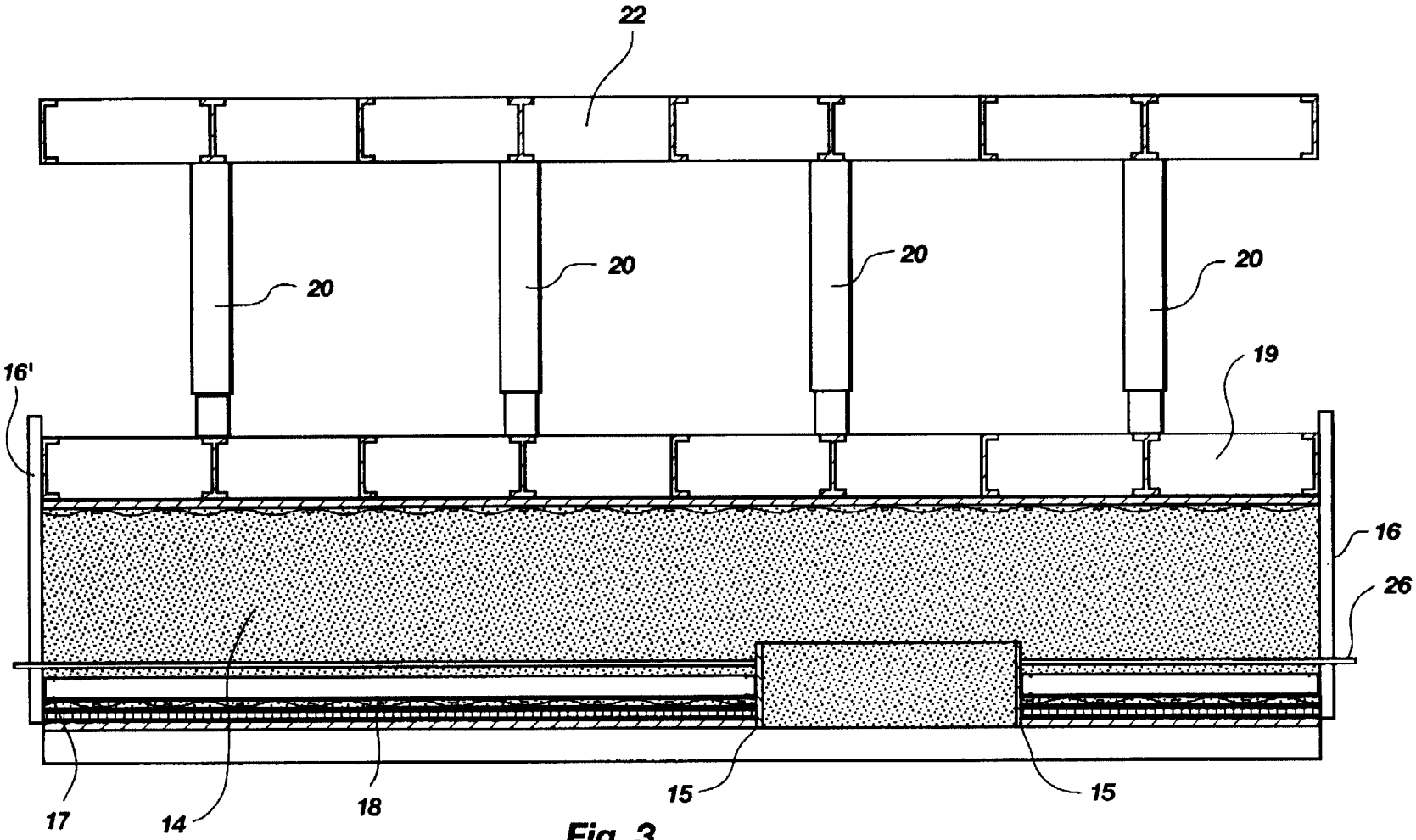
FIG. 3 Shows the pressing form with the upper press plate in place before compressing the fiber slurry.
Figure 4:
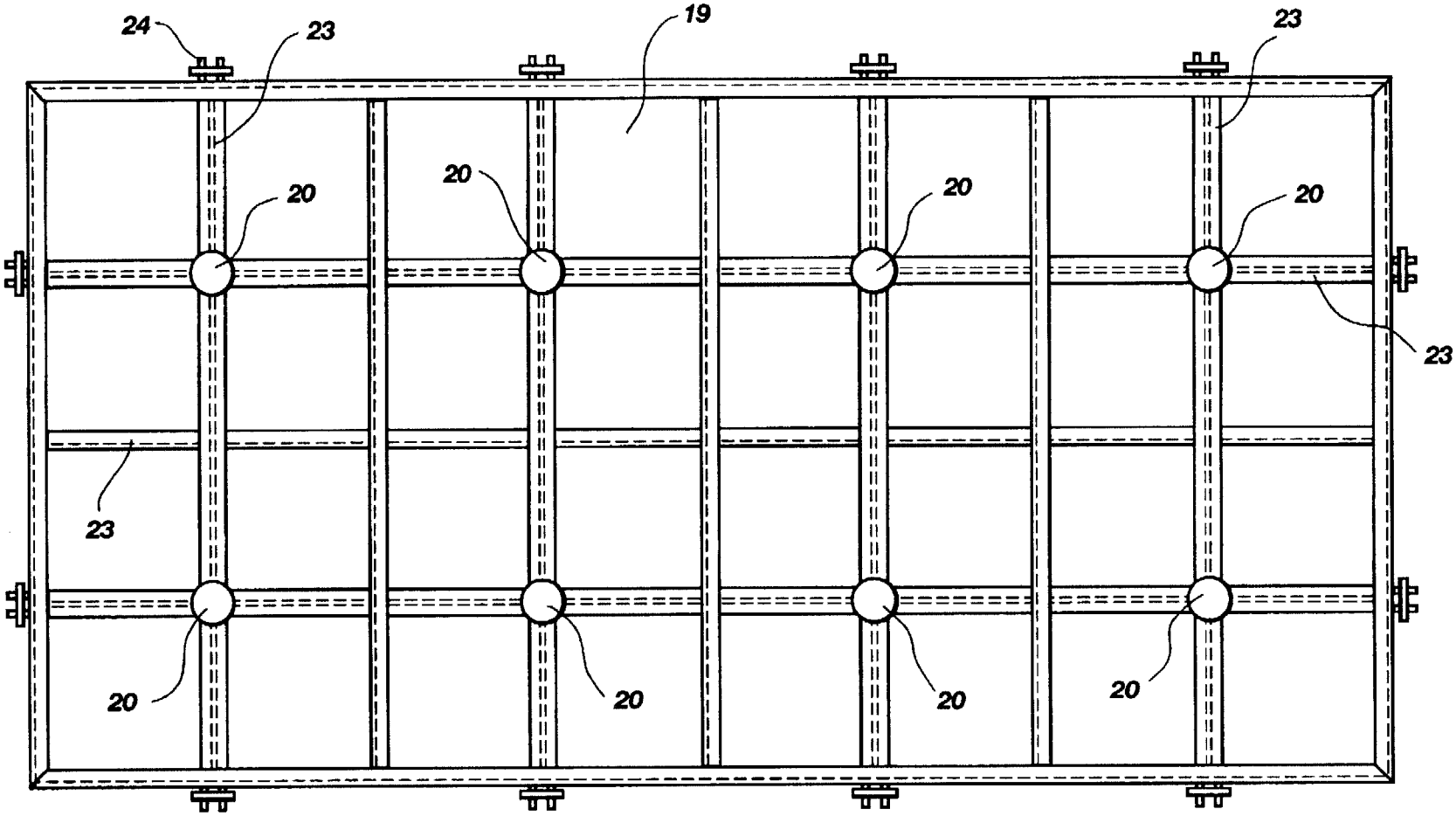
FIG. 4 Shows a top view of the pressing plate.
Figure 5:
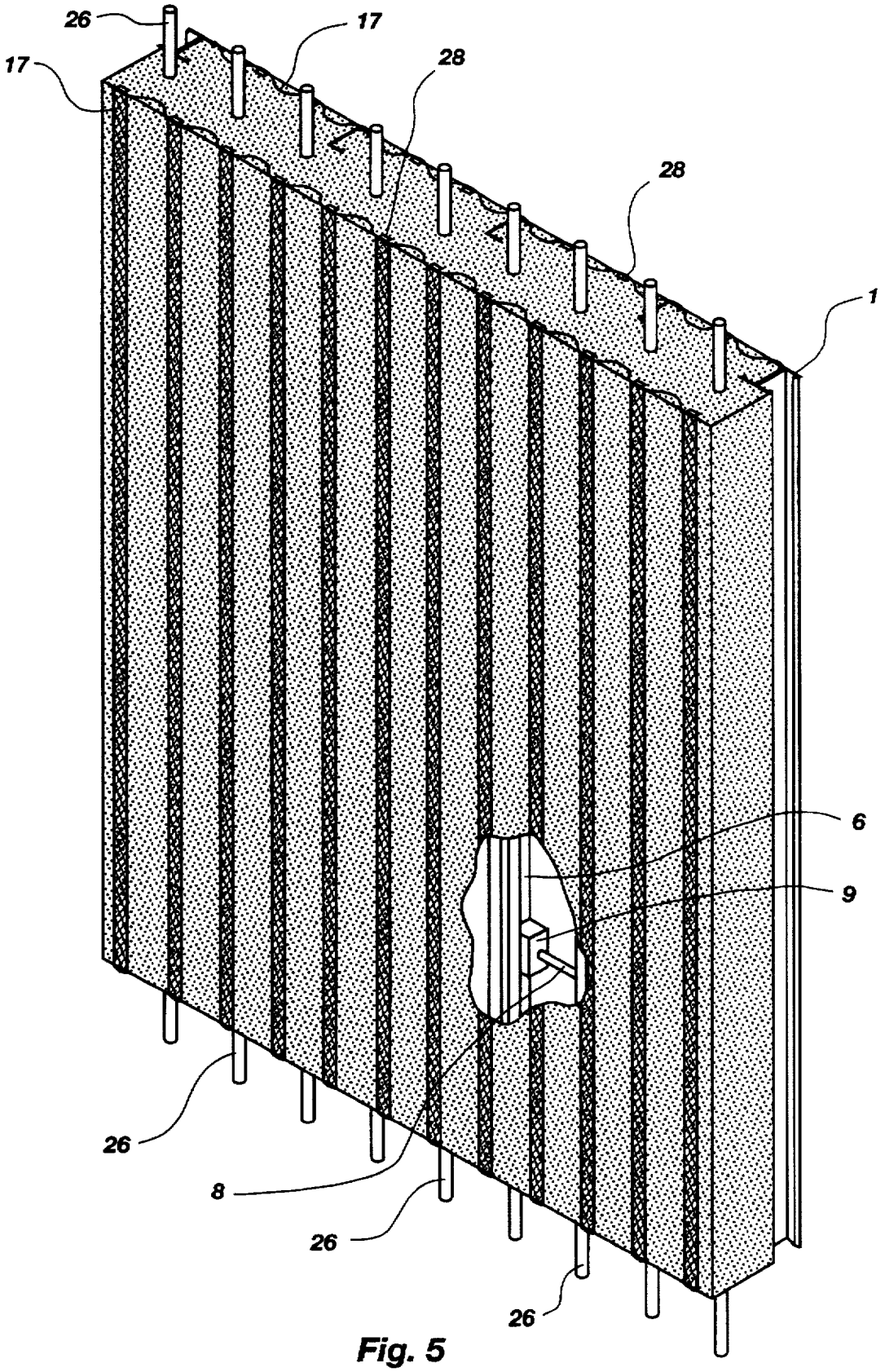
FIG. 5 Illustrates a cutaway view of a prefabricated building panel that has been compressed with removable rods in place.

Bars 28 are placed at intervals across the bottom of the form in FIG. 2. Stiff wire mesh 17 is placed across bars 28. Infrastructure of the wall panel containing sill plate 2, top plate 3, end studs 5 and 5', interior studs 6, door framing members, spandrel 12, lintels 7, wiring 8, junctions box 9, water pipes 10, and plumbing connections 11 are placed on top of the wire mesh. Frame sides 15 are placed in the infrastructure to provide knockouts for the doors and windows. Rods 26 are placed through removable sides 16 and 16' positioned over the infrastructure. A slurry of waste paper shredded and tumbled to form uniform fiber slurry 14 with a solid content of 20 to 40 percent is poured into a form as shown in FIG. 2. Bars 28 are placed at intervals on top of the uniform fiber slurry. Wire mesh 17 is placed on top of the bars 28 and uniform fiber slurry 14. Top pressure plate 19 is placed on top of the uniform fiber slurry 14. Pressure of 2,000 to 10,000 pounds per square foot is applied to top pressure plate 19 by press 22 through eight hydraulic rams 20. Top pressure plate 19 is composed of cross members 23 fastened to the outside frame by fasteners 24. Cross members 23 are positioned to apply a uniform pressure across the top pressure plate 19. After compression the uniform fiber slurry 14 is compressed into a compressed fiber core 13 which maintains its dimensions and remains stable after removal from the pressure form. The compressed fiber core 13 has a water content of less than 25% by volume. The compressed fiber, filling the door cut out frame outlined by sides 15, is knocked out of the cutout, ground up and reused in subsequent slurries.

Figure 6:
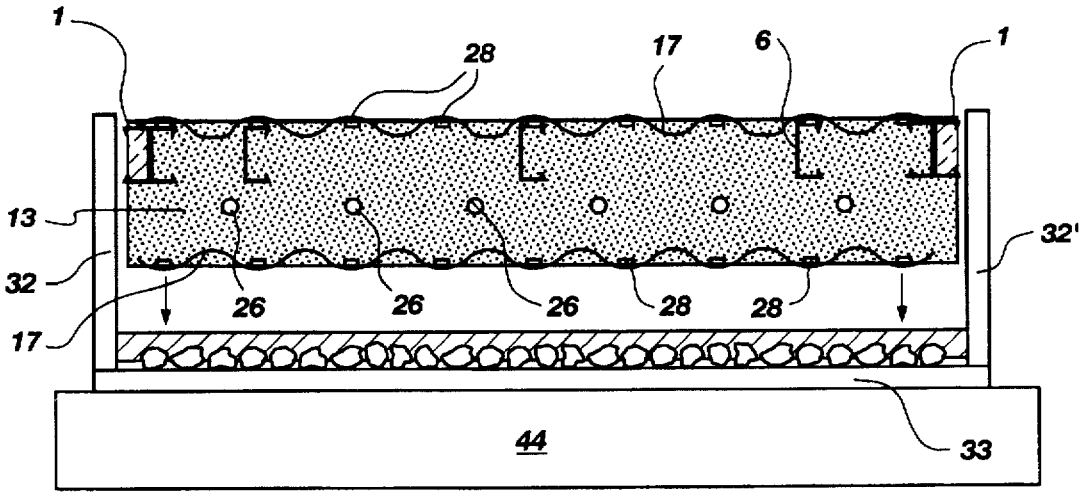
FIG. 6 Illustrates the lowering of the compressed fiber core panel into a second form with a layer of cement and stones in place in the bottom of the form.
Figure 7:
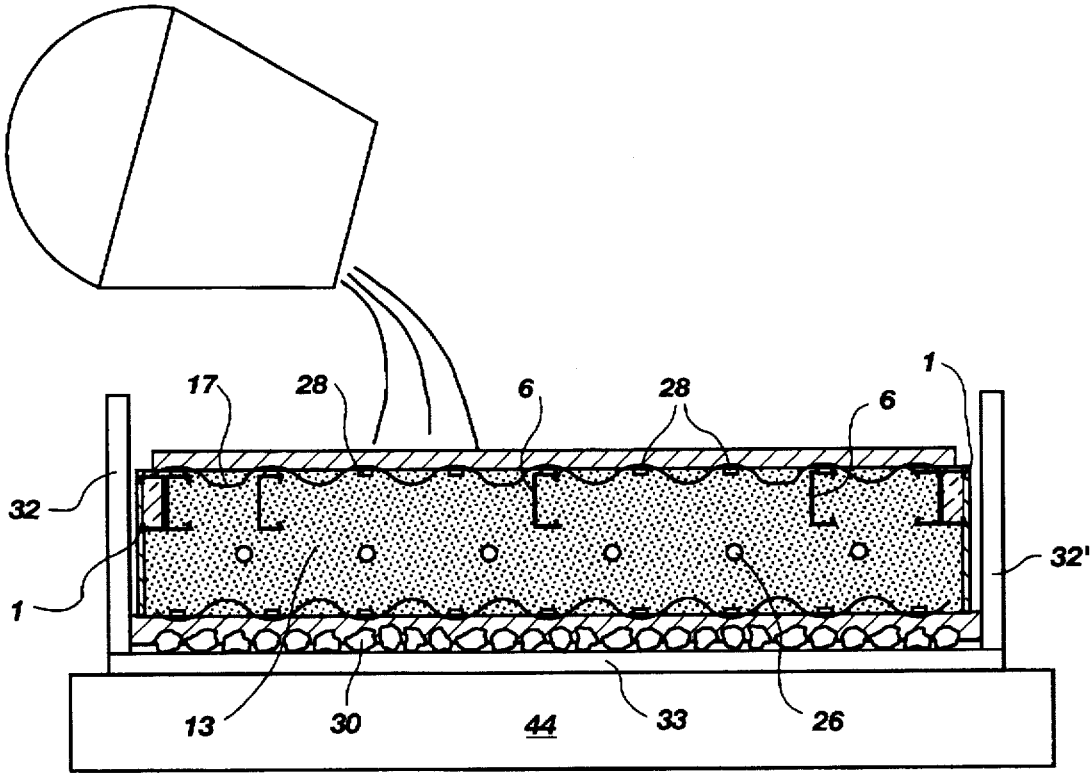
FIG. 7 Shows a layer of stucco being poured on the top and around the sides of the compressed fiber panel.
Figure 8:
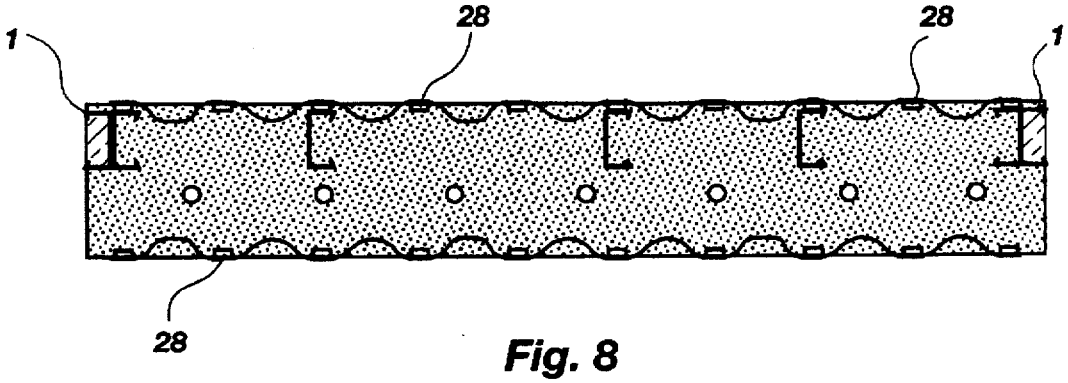
FIG. 8 Represents an end view of the compressed fiber panel with removable rods in place before the stucco layer is applied.
Figure 9:
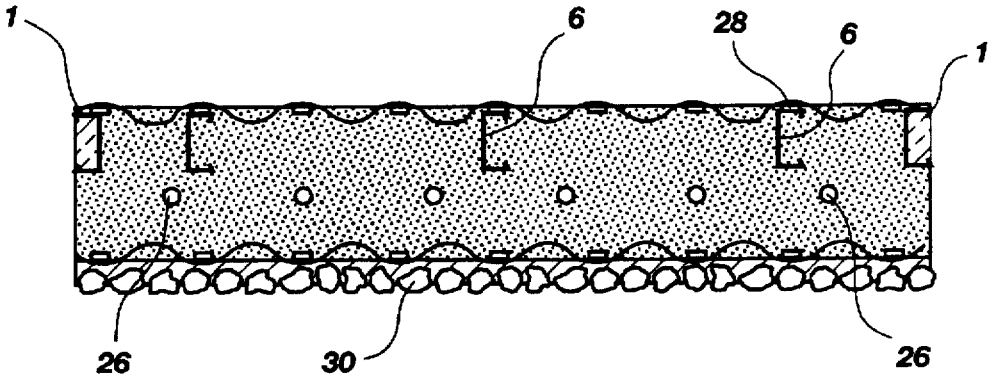
FIG. 9 Shows an end view of a compressed panel with the removable rods in place after the application of the stucco on the top side and edges and stones with stucco on the opposite side.

The pressure form is then disassembled and the sides 16 and 16' are removed from the compressed fiber core panel. Bars 28 are removed leaving mesh covered depressions in the top and bottom surfaces providing bonding points for the stucco. A layer of exterior stone 30 is placed in the bottom of the second form depicted in FIG. 6 and 7. Water is poured around the exterior stones 30 to a depth of not more than ⅓ of the height of the stone. The refrigeration unit 44 is turned on and the water is frozen. A layer of stucco is then poured on top of the frozen water and exterior stones 30. The wall panel is then lowered on to the layer of stucco. The refrigeration unit is then turned off and the water is allowed to drain off after the stucco is set, thus forming a clean exterior stone facing on the panel. The sides of this form 32 and 32' are attached to bottom of the form 33 and to two other sides that are not shown which have holes that accommodate rods 26. A layer of stucco is then poured around edges and over the top of the compressed fiber core panel section as illustrated in FIG. 7. After the stucco is set the sides 32 and 32' are detached from the form. The wall section with the exterior stone 30 facing and interior stucco 31 covering as illustrated in FIG. 9 is removed from the form. Rods 26 are removed leaving passageways. Air is blown through the passageways formed by the removal of rods 26 completing drying process.

Figure 10:
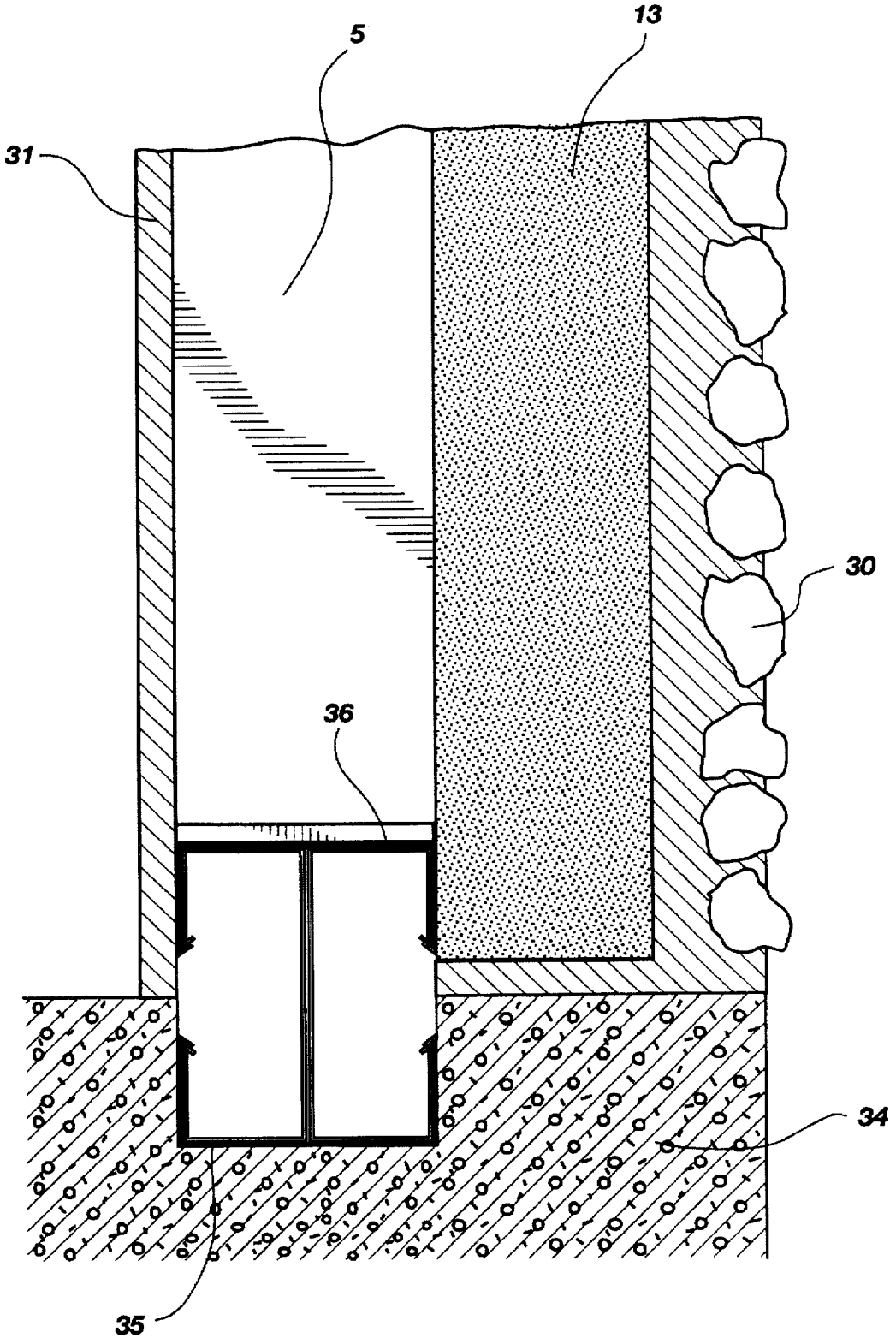
FIG. 10 Depicts a finished compressed fiber panel locked to a foundation.
Figure 11:
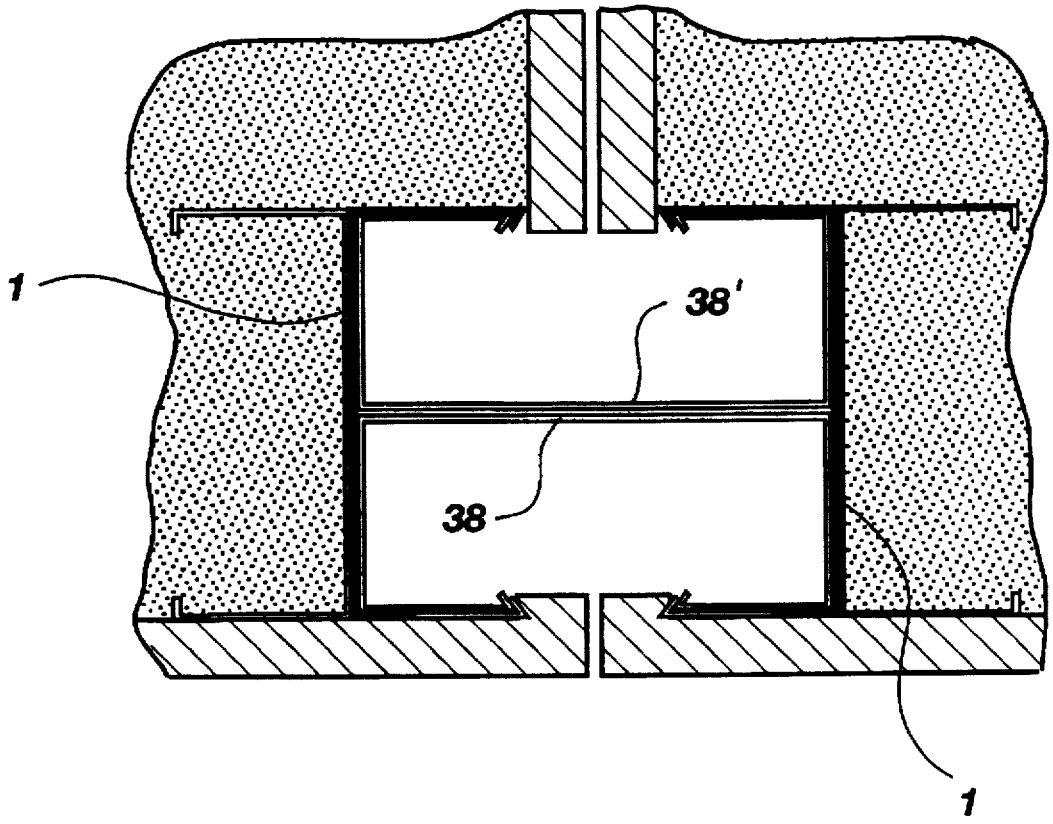
FIG. 11 Depicts a top view of two building panel sections being locked together by the insertion of a locking member.

A hollow channel member 1 is attached to the outer studs 5 and 5'. The edges of channel members 1 are bent to provide an lip along the length of each edge of the channel member. The channel members of each wall section are placed abutting each other. A locking member formed from two slightly smaller channel members 38 and 38' is forced into the channel members 1 thereby locking the wall panels together. The same type of mechanism using smaller channel members 37 and 37" can be used to lock a channel member 35 embedded in a foundation 34 to channel member 36 which is an integral part of the finished wall panel, securely fastening the wall panel to the foundation. See FIG. 10. Removable non compressible filler strips which may be plastic, wood, fiber board or any other material that does not deform under pressure are placed in channel members 1 and 36 before fiber slurry 14 is added. These removable non compressible filler strips prevent filling the channels with fiber or stucco if stucco is used as an interior covering for the wall panels. These removable non compressible filler strips remain in place until the wall panels are ready to be attached to each other or to the foundation.

Figure 12:
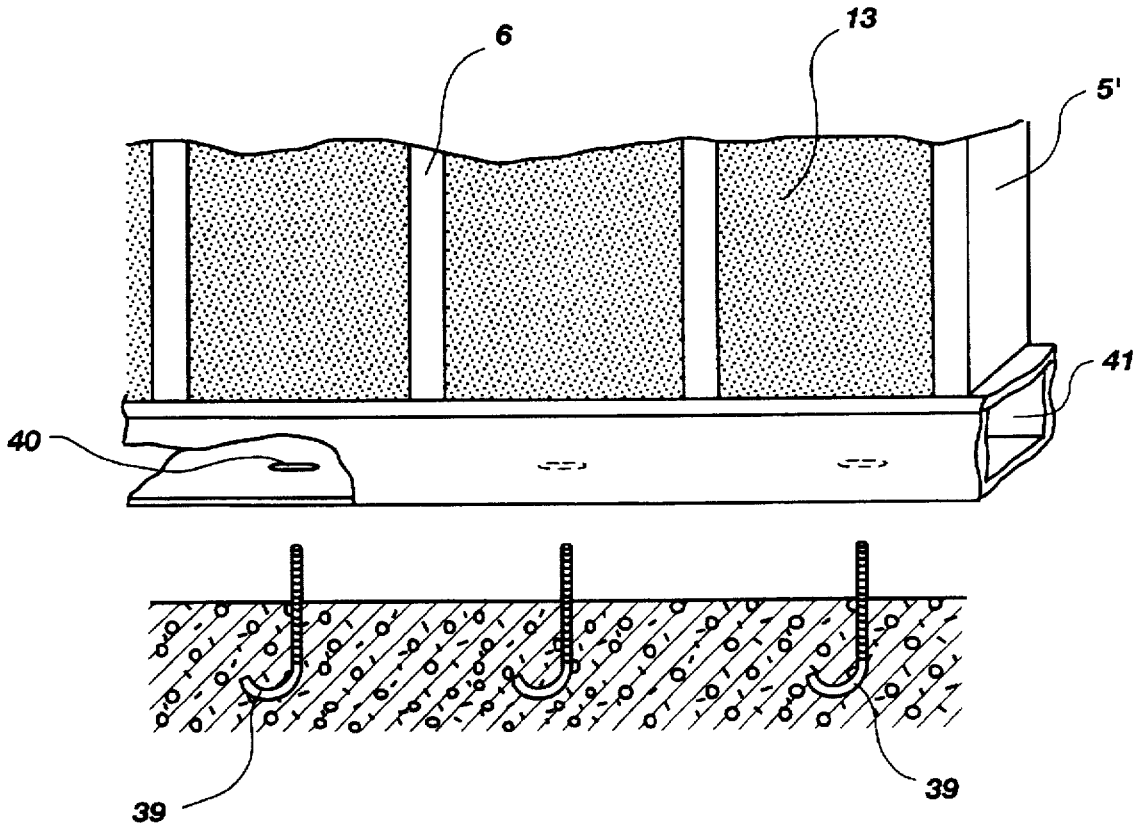
FIG. 12 Demonstrates a second means for locking a building section to the foundation on embedded bolts.
Figure 13:
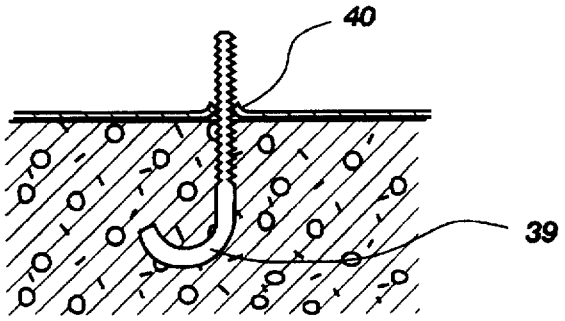
FIG. 13 Demonstrates the bolt threads crimping the edges of the slot.
Figure 14:
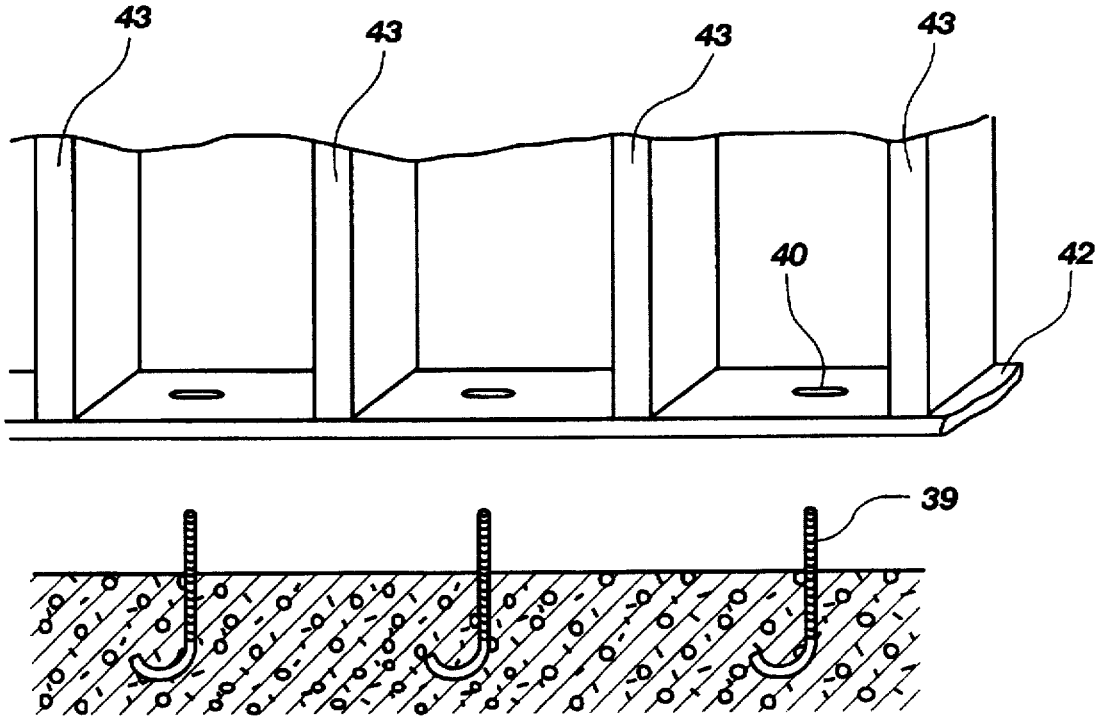
FIG. 14 Demonstrates a locking mechanism for a conventional building frame work to a concrete foundation.

Another method of fastening wall panels with or without compressed fiber is illustrated in FIGS. 12,13 and 14. The sill plate 2 is fastened to a hollow member 41 which has slots 40 spaced at intervals along the bottom. The sill plate 2 is fastened by bonding means such as welding, bolts, nails, screws or rivets (not shown) to the top of hollow member 41. In an alternative method, slots 40 are an integral part of sill plate 42 which has studs 43 attached thereto as part of wall framing as shown in FIG. 14. Bolts 39 are embedded in a concrete foundation or floor. Panels with Slots 40 are forced down on bolts 39 crimping the edges of slots 40 thereby engaging the threads of bolts 39 to firmly secure the panels to the concrete. See FIG. 13. This method of anchoring allows anchor bolts 39 to be firmly fastened to the wall sections without the necessity of screwing nuts on the ends of the anchor bolts.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A prefabricated panel designed to fit together with other prefabricated panels of the same design to form walls, floors, ceilings and roofs of buildings comprising;

a solid inner core formed by compressing a fiber slurry composed of water and fiber in a pressure form at extreme pressures;

framing members having been placed in said form before the addition of said fiber slurry;

said inner core being removed from said form and dried;

said framing members being embedded in said inner core;

a first and second covering being applied to said inner core; and said first and said second covering forming the interior and exterior surface of said prefabricated panel.

2. A prefabricated panel as claimed in claim 1 wherein one or more additional elements selected from the group consisting of electrical, communication, plumbing and heating components are placed in said form before the addition of said fiber slurry.

3. A prefabricated panel as claimed in claim 1 wherein one or more additional ingredients selected from a group consisting of water proofing materials, insecticides, antifungal agents, and fire retardants are added to said fiber slurry before compression.

4. A prefabricated panel as claimed in claim 3 wherein waterproofing materials are added to said fiber slurry.

5. A prefabricated panel as claimed in claim 1 wherein said first and second coverings are individually selected from the group consisting of, stucco, cement, stucco with embedded stones in said stucco, cement with embedded stones in said cement, mortar, mortar with embedded stones in said mortar, brick, paneling, wall board, wall board paper, paint, wall paper, and sheet rock paper.

6. A prefabricated panel as claimed in claim 5 wherein said first covering and said second covering are individually selected from the group consisting of stucco, stucco with embedded stones, mortar, mortar with embedded stones, cement, and cement with embedded stones.

7. A prefabricated panel as claimed in claim 6 containing steel mesh embedded in said inner core near the surface enabling said covering to bond with said compressed fiber core.

8. A prefabricated panel as claimed in claim 1 wherein removable rods extending through the sides of said form are placed in said form before the addition of said fiber slurry.

9. A prefabricated panel as claimed in claim 8 wherein said removable rods are removed from said inner core after compression of said fiber slurry providing passageways to promote drying of said inner core.

10. A prefabricated panel as claimed in claim 1 where said framing members are selected from the group consisting of cantilevers, trusses, sill plates, top plates, sills, joists, studs, rafters, spandrels, beams, and lintels.

11. A prefabricated panel as claimed in claim 10 wherein said framing members are formed from materials individually selected from the group consisting of aluminum, steel, wood, and high tensile plastic.

12. A prefabricated panel designed to fit together with other prefabricated panels of the same design to form walls, floors, ceilings and roofs of buildings comprising;

a solid inner core formed by compressing a waste paper slurry composed of water and waste paper products in a pressure form at extreme pressures;

framing members having been placed in said form before the addition of said waste paper slurry;

said inner core being removed from said form and dried;

said framing members being embedded in said inner core;

a first and second covering being applied to said inner core; and said first and said second covering forming the interior and exterior surface of said prefabricated panel.

13. A prefabricated panel as claimed in claim 12 wherein one or more additional elements selected from the group consisting of electrical, communication, plumbing and heating components are placed in said form before the addition of said waste paper slurry.

14. A prefabricated panel as claimed in claim 12 wherein one or more additional ingredients selected from a group consisting of water proofing materials, insecticides, antifungal agents, and fire retardants are added to said waste paper slurry before compression.

15. A prefabricated panel as claimed in claim 14 wherein waterproofing materials are added to said waste paper slurry.

16. A prefabricated panel as claimed in claim 12 wherein said first and second coverings are individually selected from the group consisting of, stucco, cement, stucco with embedded stones in said stucco, cement with embedded stones in said cement, mortar, mortar with embedded stones in said mortar, brick, paneling, wall board, wall board paper, paint, wall paper, and sheet rock paper.

17. A prefabricated panel as claimed in claim 16 wherein said first covering and said second covering are individually selected from the group consisting of stucco, stucco with embedded stones, mortar, mortar with embedded stones, cement, and cement with embedded stones.

18. A prefabricated panel as claimed in claim 17 containing steel mesh embedded in said inner core near the surface enabling said covering to bond with said compressed waste paper core.

19. A prefabricated panel as claimed in claim 12 wherein removable rods extending through the sides of said form are placed in said form before the addition of said waste paper slurry.

20. A prefabricated panel as claimed in claim 19 wherein said removable rods are removed from said inner core after compression of said waste paper slurry providing passageways to promote drying of said inner core.

21. A prefabricated panel as claimed in claim 12 where said framing members are selected from the group consisting of cantilevers, trusses, sill plates, top plates, sills, joists, studs, rafters, spandrels, beams, and lintels.

22. A prefabricated panel as claimed in claim 21 wherein said framing members are formed from materials individually selected from the group consisting of aluminum, steel, wood, and high tensile plastic.

23. A prefabricated panel designed to fit together with other prefabricated panels of the same design to form walls, floors, ceilings and roofs of buildings comprising;

a solid inner core formed by compressing a fiber slurry in a pressure form at extreme pressures;

framing members having been placed in said form before the addition of said fiber slurry;

said inner core being removed from said form and dried;

said framing members being embedded in said inner core;

a first and second covering being applied to said inner core; and said first and said second covering forming the interior and exterior surface of said prefabricated panel, said first and second coverings being individually selected from the group consisting of, stucco, cement, stucco with embedded stones in said stucco, cement with embedded stones in said cement, mortar, mortar with embedded stones in said mortar, brick, paneling, wall board, wall board paper, paint, wall paper, and sheet rock paper.

24. A prefabricated panel as claimed in claim 23 wherein one or more additional elements selected from the group consisting of electrical, communication, plumbing and heating components are placed in said form before the addition of said fiber slurry.

25. A prefabricated panel as claimed in claim 23 wherein one or more additional ingredients selected from a group consisting of water proofing materials, insecticides, antifungal agents, and fire retardants are added to said fiber slurry before compression.

26. A prefabricated panel as claimed in claim 23 wherein waterproofing materials are added to said fiber slurry.

27. A prefabricated panel as claimed in claim 23 wherein said first covering and said second covering are individually selected from the group consisting of stucco, stucco with embedded stones, mortar, mortar with embedded stones, cement, and cement with embedded stones.

28. A prefabricated panel as claimed in claim 23 containing steel mesh embedded in said inner core near the surface enabling said covering to bond with said compressed fiber core.

29. A prefabricated panel as claimed in claim 23 wherein removable rods extending through the sides of said form are placed in said form before the addition of said fiber slurry.

30. A prefabricated panel as claimed in claim 29 wherein said removable rods are removed from said inner core after compression of said fiber slurry providing passageways to promote drying of said inner core.

31. A prefabricated panel as claimed in claim 23 where said framing members are selected from the group consisting of cantilevers, trusses, sill plates, top plates, sills, joists, studs, rafters, spandrels, beams, and lintels.

32. A prefabricated panel as claimed in claim 31 wherein said framing members are formed from materials individually selected from the group consisting of aluminum, steel, wood, and high tensile plastic.

* * * * *